United States Patent [19]

Connolly

[11] 3,958,897

[45] May 25, 1976

[54] VARIABLE PITCH PROPELLER

[76] Inventor: Daniel M. Connolly, 2418 Ellis, Wichita, Kans. 67216

[22] Filed: Sept. 16, 1974

[21] Appl. No.: 502,850

[52] U.S. Cl. ..... 416/166; 416/167

[51] Int. Cl.[2] ..... B63H 3/02

[58] Field of Search.... 416/159, 163, 167, 165–168, 416/162, 164

[56] References Cited

UNITED STATES PATENTS

| | | | |
|---|---|---|---|
| 1,893,661 | 1/1933 | Smith | 416/166 |
| 2,054,810 | 9/1936 | Gaba | 416/167 X |
| 2,360,982 | 10/1944 | Sahle | 416/163 X |
| 2,536,546 | 1/1951 | Hatcher | 416/165 |
| 3,000,447 | 9/1961 | Baugher | 416/166 |

FOREIGN PATENTS OR APPLICATIONS

| | | | |
|---|---|---|---|
| 433,009 | 5/1935 | United Kingdom | 416/168 |
| 578,534 | 7/1946 | United Kingdom | 416/166 |
| 652,083 | 4/1951 | United Kingdom | 416/166 |

*Primary Examiner*—Everette A. Powell, Jr.
*Attorney, Agent, or Firm*—John H. Widdowson

[57] ABSTRACT

A variable pitch propeller assembly having a shaft mounted in a housing and operably connectable to a rotary power source. A means mounted on the shaft has a propeller blade pivotally mounted therewith. The blade has a stem portion pivotally mounted in the means. A cam is rotatably mounted in the housing and has an inclined portion angularly disposed relative to the shaft. Another means is slidably mounted in the housing and positioned between the cam and the first-named means and having a cam follower engaged with the inclined portion of the cam and having a guide means oppositely disposed to the cam follower. A rotatable member is positioned between the means slidably mounted and the first-named means and it has guide means follower engaged with the guide means and members connected with the stem portion of the propeller blade. Rotation of the cam moves the slidably mounted means and the rotatable member which rotates the stem portion of the propeller blade to be rotated thus changing the pitch of the blade.

1 Claim, 5 Drawing Figures

VARIABLE PITCH PROPELLER

BACKGROUND OF THE INVENTION

This invention is related to variable pitch propellers of the marine type. Several variable pitch propeller assemblies are known in the prior art for use on marine vehicles. These prior are devices are generally extremely complicated and have a considerable number of moving parts which rotate with the propeller hub as it turns in use. Typically, variable pitch propeller assemblies have the propeller hub rotatably mounted on a shaft that is mounted in a housing with a cam or the like positioned inside the shaft and connected by gearing, linkages or the like to rotate the propeller blades in their supporting hub in correspondence to motion of the cam. In structures such as this the cam or the like must slide constantly inside the shaft which produces a great amount of friction and wearing of the cam and other intricately formed machined parts. Some prior art propeller assemblies have the pitch changing mechanism or some portion thereof mounted on the exterior of the propeller hub and lower unit housing. These structures are undesirable because they are easily fouled by foreign objects such as grass, weeds, etc.

SUMMARY OF THE INVENTION

In a preferred specific embodiment a variable pitch propeller assembly includes a shaft mounted in a housing and operably connectable to a rotary power source with a hub rigidly mounted on the shaft and a plurality of propeller blades pivotally mounted on the hub. Each of the propeller blades has a stem portion pivotally mounted in the hub and radially disposed relative to the shaft. A cam with an inclined portion is rotatably mounted in the housing. A roller drum is slidably mounted in the housing positioned between the cam and the hub. The roller drum has a cam follower engaged with the inclined portion and a groove in an inner portion thereof oppositely disposed to the cam follower. A rotatable member is mounted between the roller drum and the hub and it has a groove follower member mounted in the roller drum groove and a plurality of elongated members individually connected to the stem portions of the propeller blades. In use the cam is rotated in the housing by an externally operated control. Rotating the cam slides the roller drum and in turn moves the rotatable member to pivot the propeller blades.

The variable pitch propeller of this invention can be used in the lower unit portion of outboard motors or in the lower unit portion of stern drive boat power units or it can be adapted for use with inboard configurations. Stern drive boat power units are sometimes referred to as inboard/outboard drives because the engine is inside the boat hull and the propeller and lower unit are outside of it. Usually the propeller and lower unit extend through the boat hull in the stern of the boat at the transom.

One object of this invention is to provide a variable pitch propeller structure overcoming the aforementioned disadvantages of the prior art devices.

Still, one other object of this invention is to provide a variable pitch propeller assembly for a marine propulsion device which has a minimum number of moving parts and which in use functions to change the pitch of the propeller blades as desired while the propeller is in motion.

Still, another object of this invention is to provide a variable pitch propeller assembly having the propeller blade supporting hub secured to a shaft that is supported in a housing by a cam and by a roller drum and a rotatable member with the shaft connected to a rotary power source. In this apparatus the cam is rotatably mounted in the housing and connected to the roller drum which is slidably mounted in the housing. Rotation of the cam through a portion of a circle of rotation slides the roller drum and in turn changes the pitch of the propeller blades by moving the rotatable member that is connected to the roller drum and the propeller blades.

Still, another object of this invention is to provide a variable pitch propeller assembly which can be used in the lower unit portion of outboard motors or on stern drive type marine propulsion units and further which can be adapted for used on inboard type boat configurations.

Various other objects, advantages, and features of the invention will become apparent to those skilled in the art from the following discussion, taken in conjunction with the accompanying drawings, in which:

Figure 1:
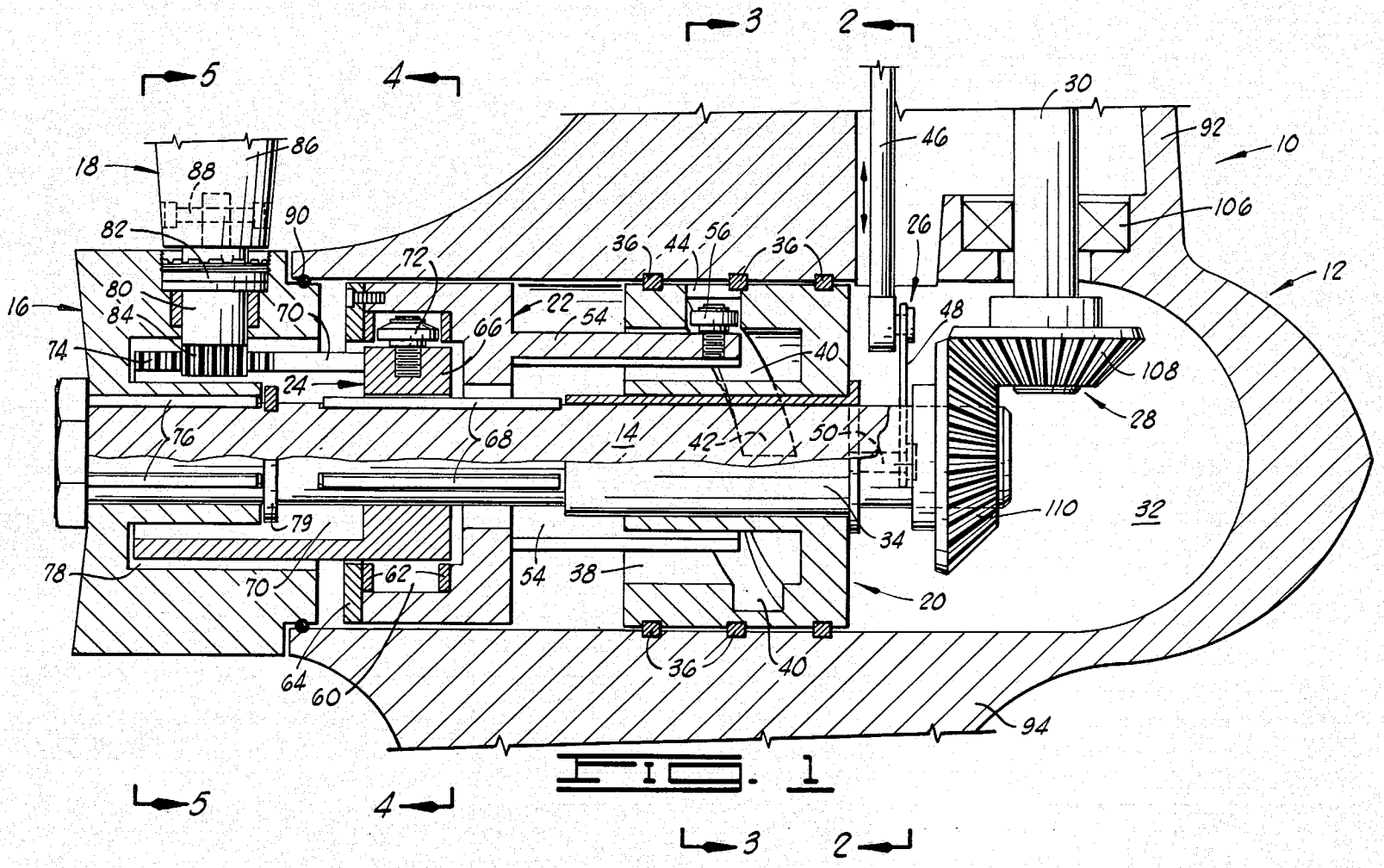
FIG. 1 is a sectional view of the variable pitch propeller assembly with portions thereof shown in full view. The assembly is shown with the housing being a portion of the lower unit portion of an outboard motor or a stern drive propulsion apparatus.

The following is a discussion and description of preferred specific embodiments of the variable pitch propeller structure of this invention, such being made with reference to the drawings, whereupon the same reference numerals are used to indicate the same or similar parts and/or structure. It is to be understood that such discussion and description is not to unduly limit the scope of the invention.

DESCRIPTION OF PREFERRED EMBODIMENT

Referring to the drawings in general and in particular to FIG. 1 wherein the variable pitch propeller assembly of this invention is indicated generally at 10. The variable pitch propeller assembly 10 is shown installed in the lower unit of an outboard motor, a stern drive propulsion unit or the like with the propeller being on the rear thereof. The variable pitch propeller assembly 12 includes a housing 12 (which in this case is the lower unit housing), a shaft 14, and a hub 16 rigidly mounted on the shaft 14 to mount a plurality of propeller blades 18. A cam assembly 20 is rotatably mounted in the housing and has an inclined portion angularly disposed relative to the shaft. A roller drum assembly 22 is an assembly slidably mounted in the housing between the cam 20 and the hub 16, it has a cam follower on one side and a roller drum groove that opens to its opposite side. A rotatable member, indicated generally at 24, is slidably mounted on the shaft 14 and connects the groove of the roller drum 22 with the propeller blades 18 in the hub 16. A linkage 26 is provided to rotate the cam 20 in the housing 12. The linkage 26 is connected to a control apparatus, not shown, to control the position of the cam 20. A gearing 28 connects the shaft 14 with a drive shaft 30 of a rotary power source.

The housing 12 is provided with a cavity 32 to enclose a portion of the moving parts of the propeller assembly 10. The shaft 14 is centrally supported in the cavity 32 by the cam 20 on one end portion and by the roller drum 22 and rotatable member 24 on its other end portion. The bearing sleeve 34 is mounted in the center portion of the cam 20 and contacts the exterior of the shaft 14. The cam 20 preferably, has a cylindrical outer surface so that it can rotate in the housing cavity 32. A plurality of ring like members 36 are mounted in grooves in the exterior portion of the cam and grooves in the surface portion of the cavity wall to guide the cam 20 so it will rotate in a stationary longitudinal position in the housing. The cam 20 has a first groove portion 38 opening on one side thereof toward the roller drum 22, and a second groove portion 40 opening to the first groove portion 38. The first groove portion 38 preferably extends substantially longitudinally into the cam 20 around its center portion substantially as shown and the second groove portion 40 extends radially outward from the first groove portion relative to the shaft 14 substantially as shown. The second groove portion 40 is inclined relative to the shaft 14 or relative to a plane passing perpendicularly through the shaft 14. The cam 20 is constructed with at least one and preferably three of the second groove portions 40 spaced therearound. The second groove portions 40 are preferably helical. The second groove portions 40 each have a lower end portion 42 in the lower end or closed end portion of the first groove portion 38 and they have an outer end portion 44 in the open end portion of the first groove portion 38.

Figure 2:
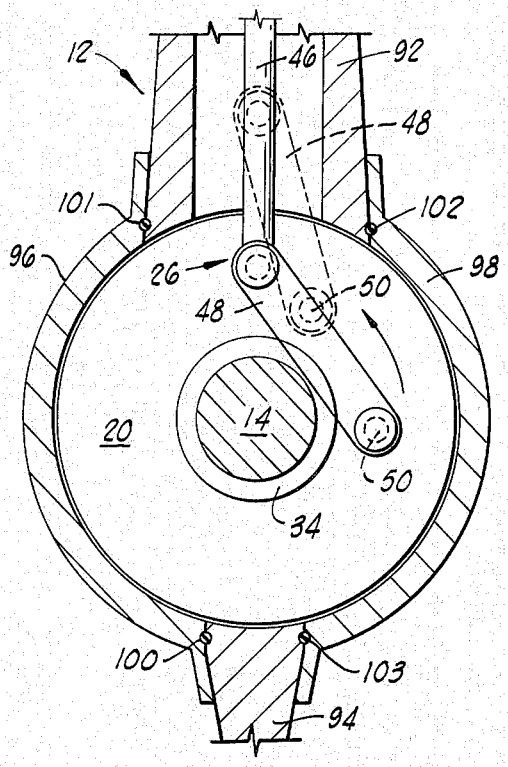
FIG. 2 is a cross-sectional view of the propeller assembly shown in FIG. 1 showing in detail the cam and rotating linkage thereof. The view is taken on line 2—2 of FIG. 1 and has the linkage shown in one position in solid lines and in alternate position in dashed lines.

The linkage assembly 26 has a push rod 46 pivotally mounted with a connecting rod 48 which is in turn pivotally mounted with a pin 50 that is secured to the cam 20. The push rod 46 moves in a vertical direction as indicated by the double headed arrow in FIG. 1. Vertical motion of the push rod 46 rotates the cam 20. FIG. 2 shows the push rod 46 and connecting rod 48 and pin 50 in solid lines in one position and the connecting rod 48 and pin 50 in a displaced position in dashed lines. An arrow indicates the direction of rotation of the cam 20 which would be the result of moving the linkage from the position shown in solid lines to the position shown in dashed lines. The push rod 46 can be connected by suitable linkage rods or cables, or any suitable equivalent to an operator at a remote point to provide for remotely controlling the position of the cam 20 in the housing. If desired, the push rod 46 can be connected with an electrically or hydraulically powered servo control system. Preferably the propeller pitch control operator is located at a place that is convenient to the boat driver.

The roller drum 22 is slidably mounted in the housing cavity 32 to move longitudinally or in alignment with the shaft 14. A plurality of ribs 52 are mounted in longitudnally positioned recesses in the exterior of the roller drum 22 and in the interior cavity wall of the housing to support the roller drum so it will slide longitudinally but will not rotate. One side of the roller drum 22 has a plurality of cam followers consisting of elongated members 54 extending from the main portion of the roller drum. The elongated members 54 have rollers 56 mounted on their outer end portions and engaged with the second groove portion 44 of the cam 20. The rollers 54 extend from the outer end of the elongated members 54 radially outward relative to the shaft 14 so the perimeter of the rollers will engage with the sides of the second groove portion 44. The roller drum 22 is open on the side opposite to the elongated members 54 and it has a groove 60 opening into its open portion. The groove 60 generally extends radially outward relative to the shaft. The roller drum groove 60 has bearing races 62 on the opposed sides thereof which form a bearing running surface for the rotatable member 24. The roller drum 22 has an end member 64 which is securable to it on the open side therof by bolts as shown. Preferably, the roller drum 22 does not contact the shaft 14.

The rotatable member 24 is slidably mounted on the shaft 14 and it is positioned in the open side of the roller drum. The rotatable member 24 supports the shaft 14 along with the roller drum 22. The rotatable member 24 has a collar like portion 66 which is slidably mounted with the shaft 14 by a splined connection having splines 68 on the shaft 14. The rotatable member 24 has a plurality of elongated members 70 extending from its collar like portion 66 which are connected with the propeller blades 18 in the hub 16. The rotatable member 66 has a roller drum follower engaged in the groove 60 of the roller drum. The rotatable member roller drum groove follower is preferably a plurality of rollers 72 mounted with the collar like portion 66 and extendng radially outward relative to the shaft 14. The rollers 72 run in the groove 60 with the perimeter of the rollers contacting the bearing races 62. The elongated members 70 have a rack type gearing 74 on their outer end portion which engages with the inner end of the propeller blades 18 in the hub 16 as described hereinafter.

The hub 16 is rigidly mounted on the shaft 14 and supports the plurality of propeller blades 18. Preferably, the hub 16 is provided with a spined mounting in its center portion to engage spines 76 on the end portion of the shaft 14. The hub 16 is secured on the shaft 14 by a lock nut or the like. A snap ring 79 is mounted on the shaft 14 at the forward end of the hub 16. The interior of the hub 16 has a grooved or hollow portion to receive the elongated members 74 of the rotatable member assembly 24. Each of the propeller blades is constructed with a stem portion 80 that is supported in a bearing and stem retaining assembly 82 in the outer portion of the hub. Each of the stems 80 has a gear 84 on its inner end portion which is engaged with the rack gearing 74 of the elongated members 70. Each of the propeller blades has a blade portion 86 which is preferably removably mountable with the stem 80 and secured thereto by locking pins or the like 88. A seal 90 is provided on the inner portion of the hub 16, its juncture with the housing 12 to provide for sealing the mechanism of the variable pitch propeller 10 to separate it from the water and foreign materials.

Figure 3:
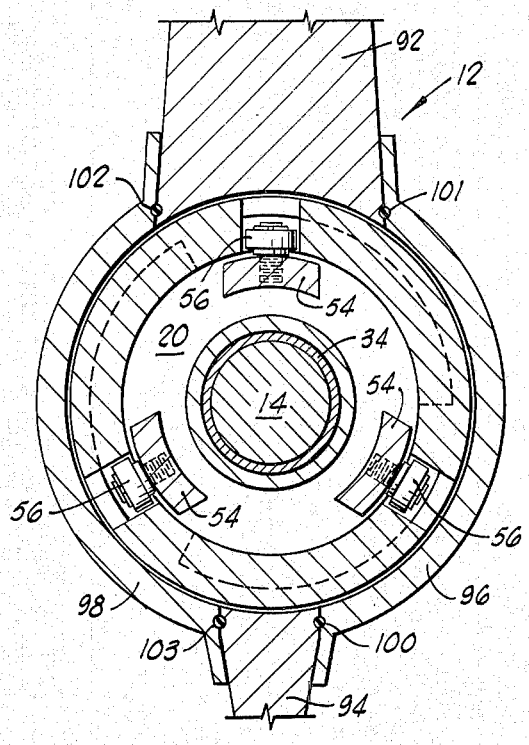
FIG. 3 is a cross-sectional view of the propeller assembly shown in FIG. 1 showing in detail the cam and cam follower with the view taken on line 3—3 of FIG. 1 and has portions thereof shown in full view for clarity.
Figure 4:
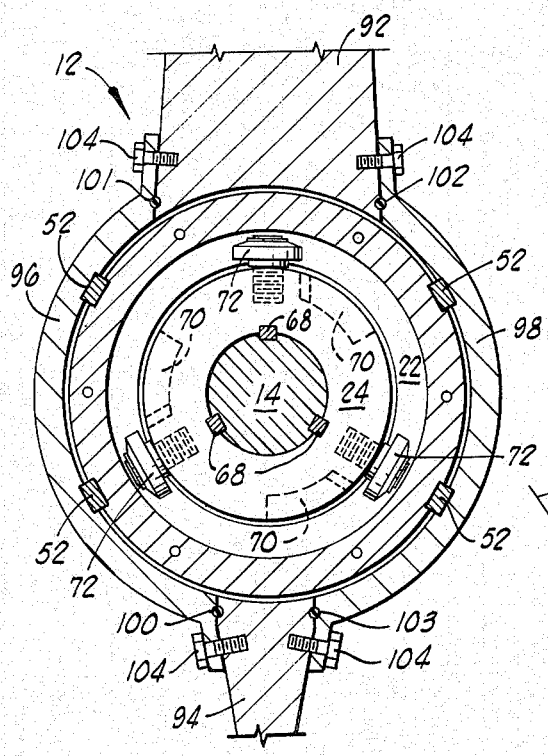
FIG. 4 is a cross-sectional view of the propeller assembly shown in FIG. 1 showing in detail the roller drum and rotatable member thereof. The view is taken on line 4—4 of FIG. 1 and has portions thereof shown in full view for clarity.
Figure 5:
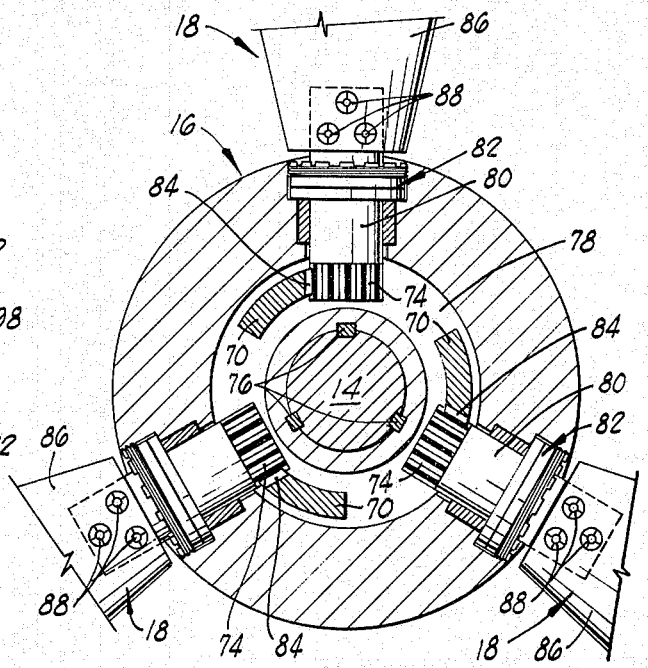
FIG. 5 is a cross-sectional view of the propeller assembly shown in FIG. 1 showing in detail the propeller hub, blades and rotatable member. The view is taken on line 5—5 of FIG. 1 and has portions thereof shown in full view for clarity.

The housing 12 is preferably constructed with an upper portion 92 above the cavity 32 and a lower portion 94 below the cavity 32 and removable sides 96 and 98 at the cavity 32. The removable sides 96 and 98 are shaped as shown in FIGS. 2–4 with their center portion forming a large portion of the cavity wall and having flanges on their edges to mate with the upper and lower portions 92 and 94 respectively. The sides 96 and 98 are provided with sealing gaskets 100, 101, 102, and 103 which are mounted in grooves in the respective pieces of the structure. Preferably, the gaskets 100–103 are constructed of a cylindrically shaped resilient material. The housing sides 96 and 98 are secured to the upper and lower portions 92 and 94 of the housing 12 by bolts 104 or other suitable fasteners as shown in FIG. 4. The bolts 104 are necessarily spaced along the edges of the sides 96 and 98 to rigidly secure them in place. In the closed cavity end of the housing the drive shaft 30 is supported in a bearing 106. Preferably, the gearing 28 includes a pair of beveled gears 108 and 110 secured to the drive shaft 30 and the shaft 14 respectively to in use rotate the shaft 14 in correspondence to rotation of the drive shaft 30. The specific gears of the gearing 28 can be selected to rotate the shaft 14 at the same speed as the drive shaft 30 or at a different speed if desired. The housing 12 as shown is representative of the type housing structure utilized both in outboard motors and in stern drive propulsion devices. In the instance where the variable pitch propeller assembly 10 is used with an inboard type boat the housing would have to be incorporated in a support for the propeller shaft. In this installation the drive shaft would be mounted in the front portion of the housing.

In the use and operation of the variable pitch propeller assembly 10 of this invention it can be incorporated into the lower unit housing of an outboard motor or a stern drive unit or it can be adapted to be used with an inboard type installation. The outboard motor and stern drive applications are preferred. In any application when it is in use the shaft 14 is rotated relative to the housing 12 which turns the propeller blades 18 in the water which in turn moves the boat or other marine vehicle. Moving the control push rod 46 rotates the cam 20 which causes cam followers to move in the second groove portions 40 of the cam 20. As the cam followers move in the cam second groove portions 40 of the cam 20 the inclined orientation of these grooved portions causes the roller drum 22 to slide in the housing cavity 32 longitudinally or in alignment with the shaft 14. As the roller drum 22 slides the rotatable member 24 is moved with it which in turn moves the gearing connecting the rotatable member 24 and the stem portions 80 of the propeller blades 18. FIG. 1 shows the variable pitch propeller assembly 10 in a reverse pitch position wherein the cam followers are in the end portion 44 of the cam second groove portions 40 and the roller drum 22 and rotatable member 24 are in the rearwardmost position. When the cam 20 is rotated to position cam followers in a center portion of the cam second groove portions 40 then the propeller blades 18 assume an essentially neutral pitch position. When the cam 20 is rotated to place the cam followers in the end portion in the cam groove which is indicated at 42 then the propeller blades 18 assume a forward pitch position. In operation of the variable pitch propeller assembly 10 the force loads on the shaft which are created by the propeller blades 18 are carried by the cam bearing sleeve 34 and by the rollers of the rotatable member 24 and by the gearing 28. This propeller assembly has only the cam bearing sleeve 34 subjected to sliding friction due to rotation of the shaft 14. The rotatable member 24 is provided with rollers. The cam 20 can be rotated when the shaft 14 is rotating or when it is stopped simply by moving the push rod 46.

The advantages of the variable pitch propeller assembly 10 are multi-fold. It enables a boat to be moved at a relatively slow speed as for trolling or maneuvering in docking areas while operating the engine at a speed substantially above idle speed. This feature is particularly important for the larger size engines because they tend to become fouled after prolonged periods of operating at low speeds which would be necessary when trolling or maneuvering with a fixed pitch propeller. The variable pitch propeller assembly is easily adjustable between the forward pitch and reverse pitch of the propeller blades thus it would have obvious use in maneuvering a boat at slow speeds such as moving it into or out of a stall at a dock. Also, the easily reversible pitch feature of the apparatus enables it to be used as a break for stopping or slowing a boat while in motion. Because the pitch of the propeller blades can be changed while the unit is in operation it allows for the propeller blade pitch to be changed to obtain optimum speed or power performance from a given engine and boat for all loading conditions at low speeds and as well as at high speeds.

In the manufacture of the variable pitch propeller structure of this invention it is obvious that it can be easily constructed to achieve the end product. The structure of the mechanism is relatively uncomplicated and can be easily constructed by techniques and operations used in the construction of transmissions and the like. The variable pitch propeller assembly can obviously be constructed as a part of the lower unit for an outboard motor or the lower unit of a stern drive propulsion device or it can be constructed for use with an inboard type configuration.

In the use and operation of the variable pitch propeller assembly of this invention it is seen that same provides a propeller assembly for a marine propulsion device which has blades that can be easily adjustable in their pitch as desired by an operator at a point remote from the propeller assembly.

As will become apparent from the foregoing description of the Applicant's variable pitch propeller assembly, relatively inexpensive and simple means have been provided to adjust the propeller blade pitch on a marine propulsion device. The variable pitch propeller structure is simple in the structure, easy to use and can be adapted for outboard motors, stern drive units and for inboard configurations.

While the invention has been described in conjunction with preferred specific embodiments thereof, it will be understood that this description if intended to illustrate and not to limit the scope of the invention, which is defined by the following claims.

I claim:

1. A variable pitch propeller comprising:

a. a housing, b. a shaft axially mounted in said housing, said shaft including a shaft beveled gear secured on an end and at least one spline member atttached on the circumferential area of the other end, c. a drive shaft of a rotary power piercing said housing, said drive shaft having a drive shaft beveled gear secured thereto within said housing to mesh with said shaft beveled gear to in use rotate said shaft, d. a cam rotatably mounted in said housing, said cam including a recess longitudinally extending into the structure of said cam, at least one groove extending radially outward from said recess relative to said shaft, said groove being inclined relative to a plane passing perpendicularly through said shaft, e. a linkage means positioned within said housing to partially turn said cam, said linkage means comprising a connecting rod pivotally mounted with said cam, a push rod piercing said housing and pivotally connected to said connecting rod, f. a roller drum slidably mounted in said housing contiguously positioned with respect to said cam, said roller drum having a cam follower extending from said drum and longitudinally movable within said recess, roller means attached to said cam follower and slidably housed within said groove of said cam, said roller drum including a structure defining an open portion on the side opposite to said cam followers, said open portion having an open portion groove situated within and generally extending radially outward relative to said shaft, g. a rotatable member slidably mounted on said shaft, said rotatable member comprising a collar which is slidably mounted with said shaft by a splined connection means having said splines on said shaft, at least one elongated member extending from said collar, said collar including a roller drum follower attached thereto for engaging said open portion groove, h. a hub rigidly mounted on said shaft and having a substantially blunt rear face, said hub including a splined mounting means in its center portion to engage said splines on the end portion of said shaft, said hub having a hollow interior portion to receive said elongated members of said rotatable member, a seal means situated on the inner portion of said hub such that its junction with said housing provides a sealing mechanism to prevent seepage of water, i. a propeller blade pivotally mounted on said hub, said propeller blade having a stem portion pivotable in said hub, and j. said elongated members of said rotatable member including a rack type gearing means on its end portion, said stem portion of said propeller blade being supported in a bearing and stem retaining assembly means in the outer portions of said hub, said stem portion including a gear means on its inner end portion to engage with said rack gearing means of said elongated members.

* * * * *